US005685254A

United States Patent [19]

Jacques

[11] Patent Number: 5,685,254

[45] Date of Patent: Nov. 11, 1997

[54] HULL ADAPTOR FOR PERSONAL WATER CRAFT

[76] Inventor: Greg Jacques, 1578 Riverside Pl., Costa Mesa, Calif. 92627

[21] Appl. No.: 552,265

[22] Filed: Nov. 2, 1995

[51] Int. Cl.[6] ..... B63B 17/00

[52] U.S. Cl. ..... 114/361; 114/270

[58] Field of Search ..... 440/38, 40–42, 440/39, 47; 239/587.1, 587.5, 588; 114/270, 361, 248, 357, 219; 60/221, 222

[56] References Cited

U.S. PATENT DOCUMENTS

| | | | |
|---|---|---|---|
| 4,337,544 | 7/1982 | Coulter et al. | 114/357 |
| 4,453,357 | 6/1984 | Zwilgmeyer | 114/357 |
| 4,625,669 | 12/1986 | Nishida | 114/270 |
| 4,664,054 | 5/1987 | Nishida | 114/270 |
| 4,667,619 | 5/1987 | Nishida | 114/270 |
| 5,117,764 | 6/1992 | Kretzer, Jr. | 114/361 |
| 5,255,625 | 10/1993 | Hattori | 114/248 |
| 5,433,635 | 7/1995 | Kobayashi | 440/38 |

FOREIGN PATENT DOCUMENTS

| | | | |
|---|---|---|---|
| 0299996 | 12/1990 | Japan | 440/47 |

*Primary Examiner*—Edwin L. Swinehart
*Attorney, Agent, or Firm*—Morland C. Fischer

[57] ABSTRACT

A second hull adaptor is provided for use with a jet powered personal water craft. The second hull provides for the craft to be more buoyant and stable even when used by full-sized adults. The second hull has a water induction channel which specifically directs the movement of water through the jet pump thereby increasing speed. It further has angled sides and diverging chines for increased speed and improved handling. An adjustable sleeve surrounds the water exhaust nozzle allowing for further adaption of the craft to water conditions or for specific riding styles. The sleeve may be adjusted so as to be flush with the rear transom to a position fully extend beyond the transom as desired.

12 Claims, 4 Drawing Sheets

4
6
6
6
2
12
26
5
19
10
8
16
14
18
12
20

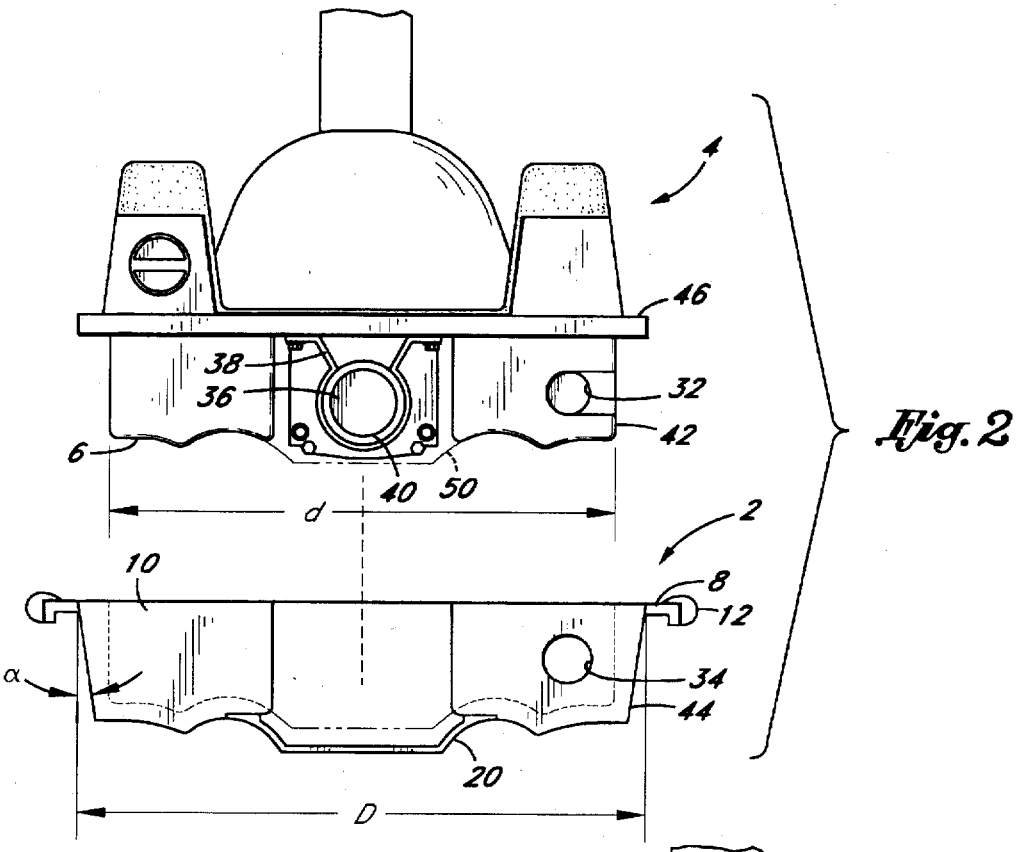
Fig. 2
Fig. 11
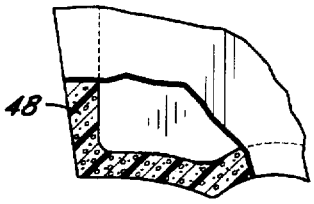
Fig. 3
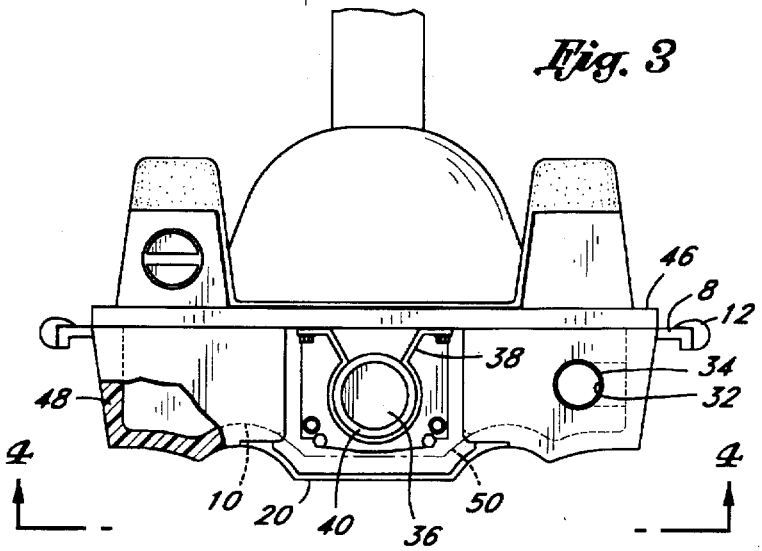

Fig. 6
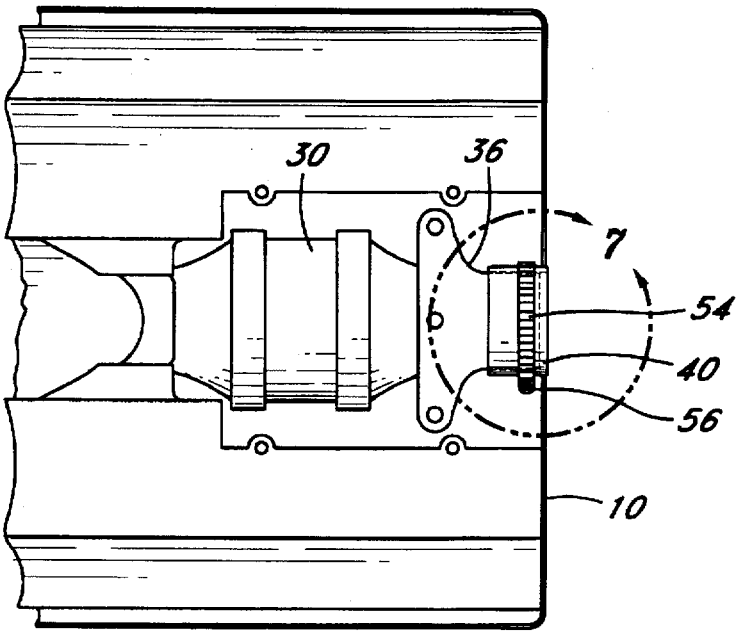
Fig. 7
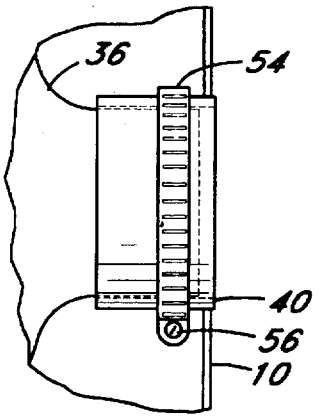
Fig. 8
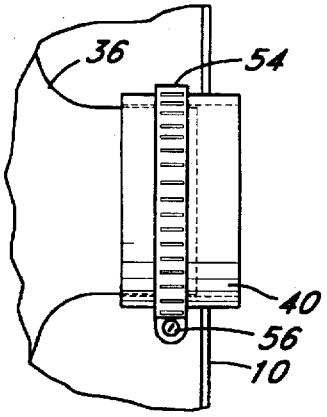
Fig. 9
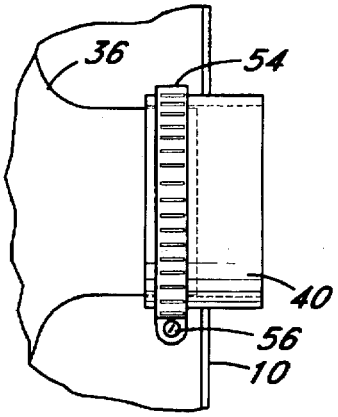
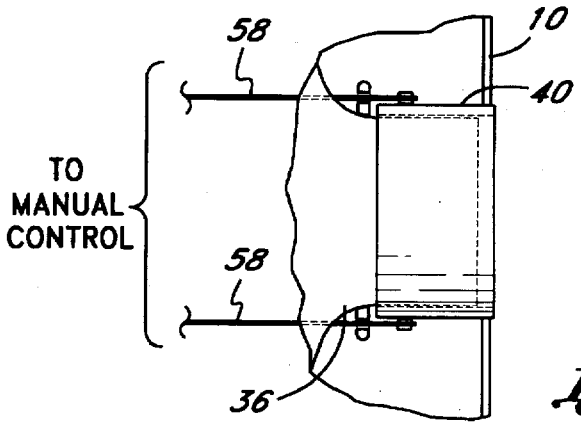
Fig. 10

HULL ADAPTOR FOR PERSONAL WATER CRAFT

FIELD OF THE INVENTION

This invention relates to jet powered personal water craft, and, more particularly, to a uniquely shaped second hull which is adapted to be coupled to the water craft and which has an enlarged induction channel and diverging chines able to direct the flow of water around the hull itself and into the jet pump housing. The second hull comes with an adjustable sleeve for the water exhaust nozzle. The second hull, which when combined with the water craft, increases buoyancy, speed, stability and maneuverability especially when a smaller craft is used by adult-sized individuals.

BACKGROUND ART

Jet powered personal water craft (hereinafter "craft") have become enormously popular in recent years. In a prominent configuration the craft is powered by a small engine located toward the front of the craft's hull. An intake channel is formed in the bottom of the hull somewhat after the engine. The channel extends aft to abut a jet pump housing. The hull of the craft typically has vertical or nearly vertical sides. The chines on the underside of the hull are essentially parallel. A major disadvantage of the hull is its draft, especially in some of the smaller sized crafts such as Kawasaki Jet Ski model 300, 440 and 550. The standard hull is reasonably functional for use by smaller riders, but adult-sized individuals find that there is a loss of buoyancy, speed, stability and maneuverability when riding the craft. Inasmuch as personal water craft have small engine capacities and small pump capacities, the design of the craft must be more efficient for satisfactory control and operation.

Presently there is nothing available to deal with these problems. When the owner of a craft becomes aware of the design disadvantages, namely the parallel chines, the vertical sides, and shallow draft, there are no corrective measures available. As a result, the owner of the craft must simply live with the inefficient performance of the craft.

SUMMARY OF THE INVENTION

In general terms, the invention provides for a second hull which attaches to the original hull of a jet powered personal water craft. The additional structure of the second hull in itself increases the draft and therefore the stability of the craft. This permits a small craft to be used by an adult-sized rider without the loss of stability and handling which would normally occur. The second hull has sides which angle towards the center of the craft. The chines of this second hull flair or diverge running from fore to aft directing the water in such a way as to increase the speed of the craft. The water induction channel of the second hull is enlarged thereby providing a greater volume of water to the jet pump housing. This is important to maintain power or acceleration through the water as well as the handling of the craft.

An adjustable sleeve is positioned about the water exhaust nozzle. The sleeve may be positioned such that its aft end is flush with the rear transom. In this position the craft slides as seen in trick water skiing. As the sleeve is extended beyond the rear transom, the craft becomes more stable and turns quickly as in slalom skiing. When the sleeve is extended maximally, the craft is especially stable and fast as needed for straight racing. In addition to the effects of water skiing, the sleeve allows adjustment for water conditions.

The more turbulent the water, the greater the sleeve could be extended thereby increasing the stability of the craft.

BRIEF DESCRIPTION OF THE DRAWINGS

FIG. 2 is a rear elevation of a personal water craft with the second hull removed;

FIG. 3 is a rear elevation in partial cross-section of the second hull coupled to a personal water craft;

FIG. 6 is a partial bottom view taken along lines 6—6 of FIG. 1;

FIG. 7 shows an enlarged detail of a sleeve taken from FIG. 6;

FIG. 8 is a bottom elevation view showing the sleeve of FIG. 7 partially extended;

FIG. 9 is the bottom elevation view showing the sleeve of FIG. 7 fully extended; and FIG. 10 is the bottom elevation view of a second embodiment of the sleeve.

FIG. 11 is an enlarged detailed view, with parts broken away, of the port side of the stern of the water craft, as seen in FIG. 3.

DESCRIPTION OF THE PREFERRED EMBODIMENT

Figure 1:
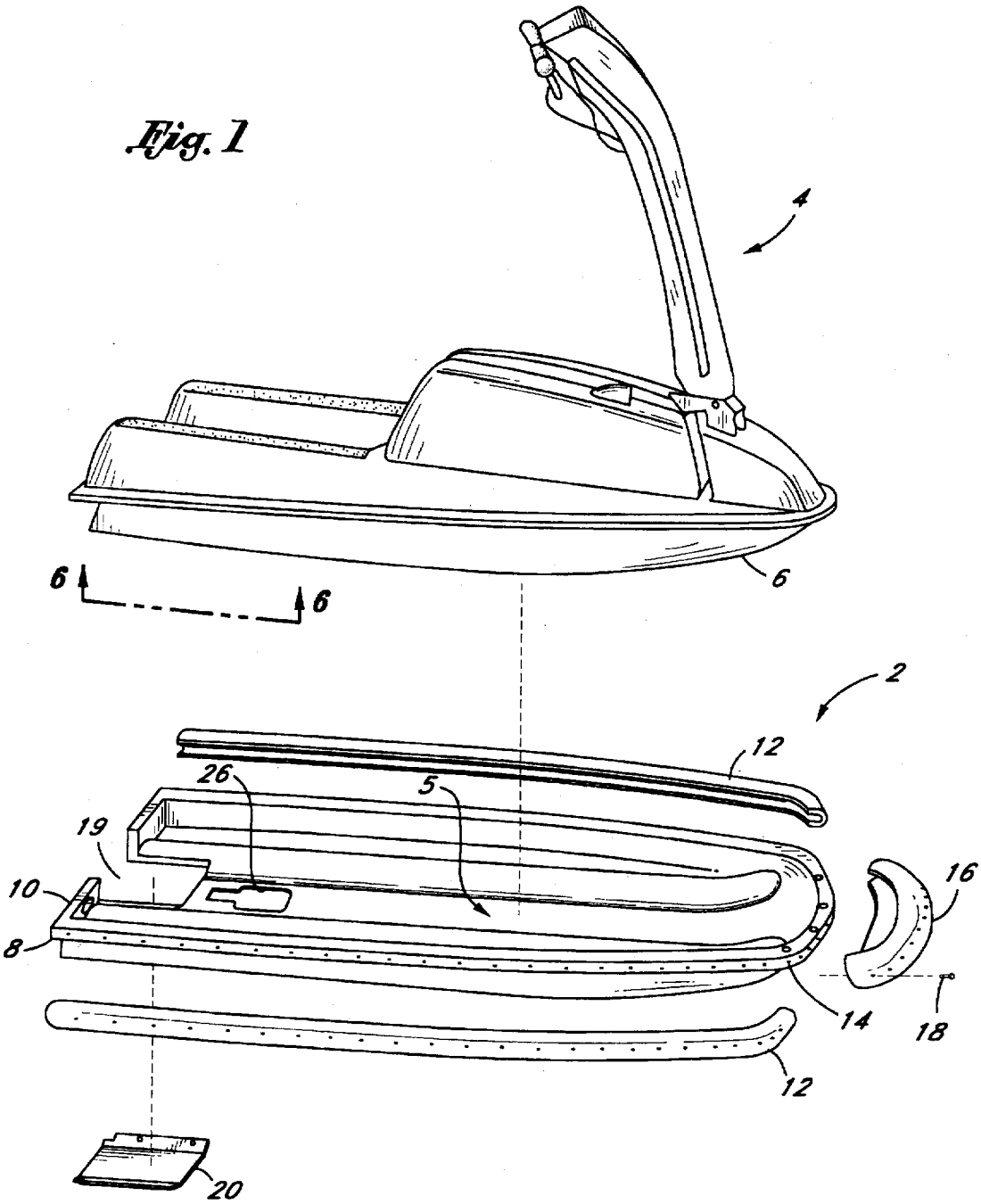
FIG. 1 is a perspective view of a personal water craft with an exploded view of the second hull removed.

The second hull 2 for a jet powered personal water craft 4 is now described while referring to FIG. 1. The craft 4 shown is a Kawasaki Jet Ski model 550. Configurations for other craft models vary somewhat in size, etc., but have substantially similar configurations. The interior 5 of second hull 2 is sized and contoured to snugly fit about the exterior hull 6 of craft 4. Rail 8 of the second hull 2 surrounds the upper outer edge of hull 2 with the exception of the rear transom 10. In the aft portion of second hull 2, the rail 8 lies flush with the rear transom 10. Second hull 2 may be manufactured from a synthetic polymer, fiberglass or some combination of material which is durable, resistant to saltwater, waterproof, and relatively lightweight. The preferred material is polyethylene with a polyethylene foam core.

Trim 12 is attached to rail 8 providing a cushion should the craft bump against another craft, pier, or the like. The trim 12 is manufactured from a softer synthetic polymer or rubber or similar material usually supported on a stainless steel base. Trim 12 is attached in a conventional manner to the rail. In this embodiment, trim 12 is secured to rail 8 by means of countersunk screws (not shown) which are inserted through trim 12 and into the trim holes 14 positioned on the lateral portions of rail 8. In some cases, the trim screws may continue through the rail 8 and into craft 4 thereby providing some attachment means between second hull 2 and craft 4. Trim 12 does not continue completely around the front or bow portion of rail 8. When craft 4 is coupled to the second hull 2 (see FIG. 3), the front bumper 16 is then attached by means of bumper bolts 18. The bumper bolts 18 are also countersunk into front bumper 16, inserted through rail 8 and into the bow portion of craft 4 thus providing an attachment means between second hull 2 and craft 4. Bumper 16 overlaps the fore ends of trim 12 to protect it from being removed or loosened by the force of water about the bow as the craft moves through the water.

Figure 4:
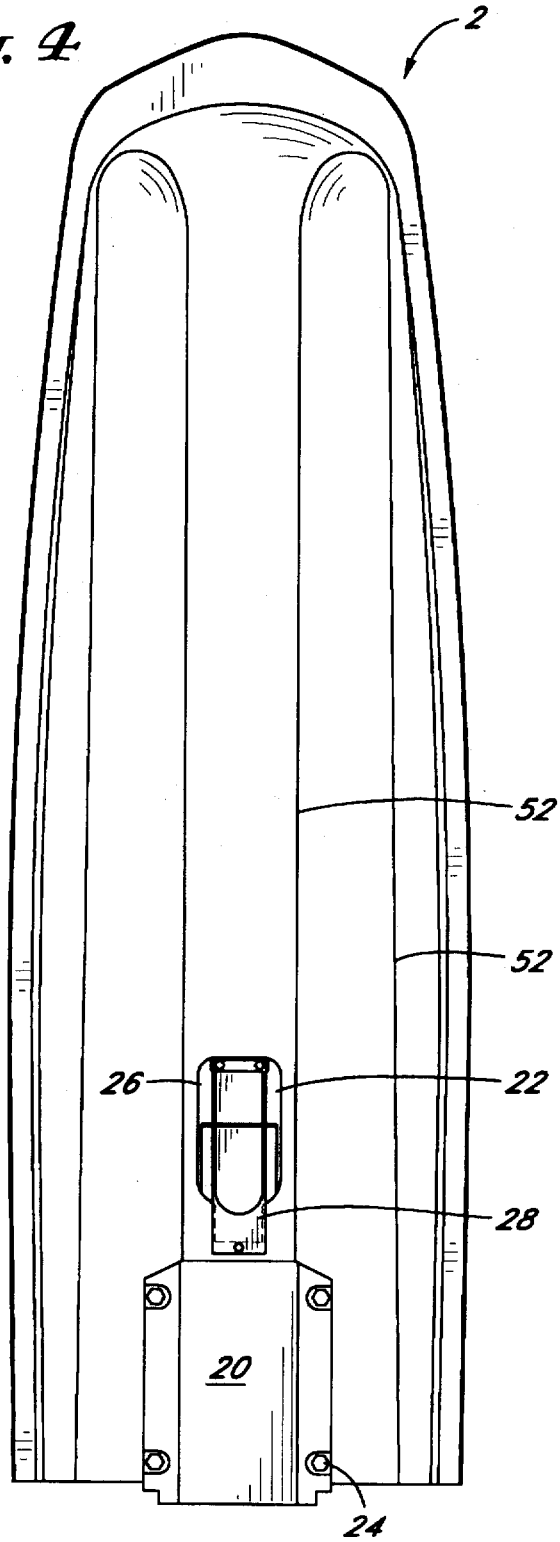
FIG. 4 is a bottom view of the second hull without the trim and front bumper taken along lines 4—4 of FIG. 3.

On the bottom and near the stem of second hull 2 is slot 19. Slot 19 accommodates water jet pump 30 (seen in FIG. 6) of water craft 4. Enclosing slot 19 is ride plate 20 (seen in place in FIGS. 2–4). Ride plate 20 is typically wider than would usually be seen on the smaller water craft 4. In combination with the enlarged water induction channel 22 seen in FIG. 4, ride plate 20 increases the stability and turning properties of craft 4 having second hull 2 attached. The ride plate 20 is typically manufactured from metal or other strong material resistant to salt water. Best seen in FIG. 4, ride plate 20 is attached by ride plate bolts 24 through the bottom of second hull 2 and into craft 4 further securing second hull 2 to craft 4. In the bottom of second hull 2 is the water induction channel opening 26. As seen in FIG. 4, a water scoop device 28 fits over water induction channel opening 26 and directs water into the water induction channel 22 toward the water jet pump 30 (seen in FIG. 6) positioned in craft 4.

Referring now to FIGS. 2 and 3 which show rear views of craft 4 and second hull 2 before and after the coupling of craft 4 to second hull 2, respectively. In the craft shown, the engine exhaust pipe 32 exits from the rear of craft 4. Therefore, to accommodate exhaust pipe 32, rear transom 10 of the second hull 2 has exhaust port 34 through which the exhaust from exhaust pipe 32 passes. In other models of personal water craft, the engine exhaust may exit from the side of the craft or from other positions along the rear. The second hull would, of course, be constructed to accommodate this variation by placing the exhaust port in such a position on the second hull to permit the exhaust pipe to properly vent from the craft. In all models, the water exits the water jet pump 30 (seen in FIG. 6) somewhere in or near the rear. Water exhaust nozzle 36 is supported by bracket 38 positioned somewhat anterior to the stern of craft 4. The terminal or aft portion of water exhaust nozzle 36 is surrounded by an adjustable sleeve 40 (better seen in FIGS. 6–10). It is possible that some water craft may have more than one exhaust pipe and more than one water exhaust nozzle. The second hull could readily be adapted to accommodate such variations.

The sides 42 of craft 4 are essentially vertical. The sides 44 of second hull 2 are angled inward toward the center bottom of the hull. The preferred angle $\propto$ is 2 to 13 degrees for the Kawasaki Jet Ski model 550 although the angle may vary with other water craft. The interior 5 of the second hull 2 is shaped to conform with the exterior configuration of the water craft hull 6. To produce the angled sides 44, the polymer or other material from which sidewall 48 is manufactured, becomes thicker toward the upper surface ensuring a snug fit for the more vertical craft sides 42. The angled sides allows for greater speed and easier handling of the craft. The structured composition and strength of second hull 2 provides considerable protection to the water craft 4. Most personal water craft have relatively thin hulls making them vulnerable to dents or, more importantly, to punctures. As a double hulled craft, especially with the material used for the second hull, there is much less risk of puncture damage and the possible resultant loss of the craft or rider.

Rail 8 of second hull 2, rather than being a straight extension as is the rail 46 of craft 4, extends beyond the second hull side 44 and then bends downward at a 90° angle forming an L-shaped structure. This rail structure restrains the upward flow of water beneath the L-shaped structure as the craft moves through the water resulting in a dynamic lift to the craft. Trim 12 attaches to rail 8 on its lateral and upper surface. Rail 8 also provides a means whereby the craft maybe grasped and lifted and thus transported into and out of the water. In the prow, bumper 16 attaches along the lateral edge of rail 8 by means of countersink screws. As can be seen in FIGS. 2 and 3, the base plate 50 of craft 4 is removed before the craft is inserted into the second hull 2. An added advantage of second hull 2 is that ride plate 20 is generally larger than base plate 50 thereby enabling the craft 4 with second hull 2 to bite into the water and provide greater stability and maneuverability for the craft.

Figure 5:
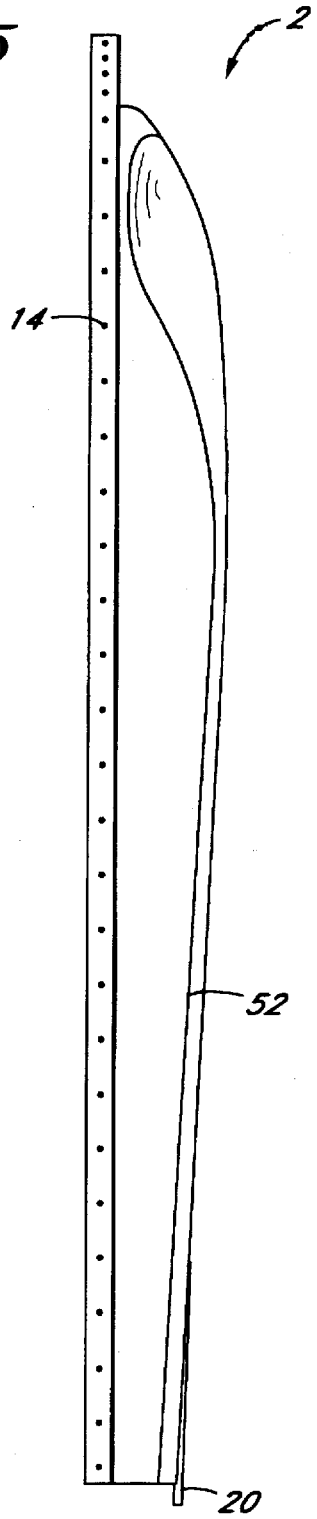
FIG. 5 is a side elevation view of the second hull of FIG. 4.

FIGS. 4 and 5 show the chines 52 of the second hull 2 of the present invention. The chines of most water craft run parallel or essentially parallel along the bottom of the hull. Chines 52 of second hull 2 diverge slightly outward moving from fore to aft along the bottom of the hull. This divergence affects the flow of water about the hull resulting in an increase in the speed of the craft. The second hull 2 also provides an enlarged water induction channel 22. The enlarged water induction channel 22 allows a greater volume of water to move into the channel and towards the water jet pump 30 (seen in FIG. 6). The water is further controlled by a water scoop device 28 which also urges a greater flow of water towards the water jet pump 30. Inasmuch as supplying water to pump 30 is significant in achieving the speed of the craft, the improved flow and volume of water increases the maximum speed. Water which does not enter the water jet pump 30 continues along the water induction channel 22 and across ride plate 20.

A sleeve 40 of the present invention is seen in FIGS. 6–10 surrounding water exhaust nozzle 36. Water is directed through water induction channel 22 (seen in FIG. 4) and water scoop device 28 (seen in FIG. 4) into the water jet pump 30 and then out water exhaust nozzle 36. Sleeve 40 may be adjusted by means of snail clamp 54 having a standard adjustment means 56 (FIGS. 6–9). Sleeve 40 may be adjusted such that it is flush with rear transom 10 (FIGS. 6 and 7) or may be extended slightly beyond the transom 10 (FIG. 8) or may be fully extended (FIG. 9). The embodiment of FIGS. 6–9 shows the adjustment of sleeve 40 by means of snail clamp 54. Such adjustments of the sleeve may also be made by a pulley or gear system 58 controllable at the fore or at the steering mechanism of the craft 4. Sleeve 40 adjustments allow the craft to adapt to varying water conditions as well as a variety of riding styles. For instance, for trick skiing, the flush position of sleeve 40 (FIGS. 6 and 7) is preferred and allows the craft to slide. For slalom skiing, a partial extension of sleeve 40 increases control and stability (FIG. 8). At the greatest extension of sleeve 40, the craft is most stable and has the greatest control (FIG. 9). The fullest extension position is preferred for straight line racing, for instance.

The addition of second hull 2 to personal water craft 4 immediately increases the draft of the craft providing greater stability and buoyancy. This allows a smaller water craft which may barely move through the water and may readily capsize when ridden by an adult-sized rider to now be stable, swift, and maneuverable as would a larger type water craft. To maintain speed and maneuverability, the deeper induction channel, the larger ride plate, the diverging chines and adjustable sleeve all contribute to the improved performance even with a larger rider and heavier personal water craft.

It will be apparent that while a preferred embodiment of the invention has been shown and described, various modifications and changes may be made without departing from the true spirit and scope of the invention. For example, while a second hull adapter has been shown on a jet ski, it may also be applied to such sit down water craft devices known as wave riders, as well as other type water craft.

Having set forth a preferred embodiment of the invention, what is claimed is:

1. A second hull to be coupled to a water craft which has a water jet outlet and a first hull which has an exterior surface including a bottom surface and side surfaces, said second hull comprising:

a hull body sized and shaped to closely fit the exterior surface of the first hull of the water craft so that at least a portion of the first hull can be inserted therein, said hull body also having a front, a back, and a bottom surface and at least one chine at said bottom surface of said hull body to increase the flotation and stability of the water craft, a slot in said bottom surface to receive the water jet outlet of the water craft; and a ride plate secured across said slot in the bottom surface of said second hull.

2. The second hull of claim 1 wherein said hull body is composed of polyethylene with a polyethylene foam core.

3. The second hull of claim 1 further comprising a plurality of chines diverging from each other from said front to said back of said hull body.

4. A second hull to be coupled to a water craft which has a water jet outlet and a first hull which has an exterior surface including a bottom surface and side surfaces, said second hull comprising:

a hull body sized and shaped to closely fit the exterior surface of the first hull of the water craft so that at least a portion of the first hull can be inserted therein, said hull body also having a front, a back, and a bottom surface and at least one chine at said bottom surface of said hull body to increase the flotation and stability of the water craft, said bottom surface has separate openings therethrough for water intake and water expulsion.

5. The second hull of claim 4 wherein said at least one chine at said bottom surface of said second hull is formed by transitions in curvature of said bottom surface, said chine extending generally from front to back of said hull body.

6. In combination:

a water craft including an engine exhaust pipe, a water exhaust nozzle and a first hull having a bottom and a rear transom;

a second hull including an engine exhaust port and a water exhaust port formed therein, said second hull having a bottom and being sized to completely surround and closely fit the bottom and rear transom of said first hull such that said engine exhaust pipe and said water exhaust nozzle of said water craft extend through respective ones of said engine exhaust port and said water exhaust port of said second hull; and fastener means for attaching said second hull to the first hull of said water craft.

7. The combination recited in claim 6 wherein the bottom of said second hull is curved, said second hull also having a plurality of outwardly diverging chines that extend generally longitudinally along said bottom so as to increase the stability of said water craft, said plurality of chines being formed by transitions in the curvature of said bottom.

8. The combination recited in claim 6, wherein said second hull has inner and outer surfaces and a synthetic polymer foam located between said inner and outer surfaces.

9. The combination recited in claim 6, wherein the first hull of said water craft has vertical side walls and said second hull has side walls which are angled relative to the vertical side walls of said first hull so as to extend inwardly towards the bottom of said second hull.

10. The combination recited in claim 6, wherein said water craft also includes a water jet pump that communicates with said water exhaust nozzle, said second hull also having a slot formed through said bottom within which to accommodate said water jet pump and a water induction opening formed through said bottom through which water is directed for receipt by said water jet pump.

11. The combination recited in claim 6, wherein said water exhaust nozzle of said water craft is surrounded by a position adjustable sleeve that is adapted to be displaced from a position flush with the rear transom of said first hull to a position beyond said rear transom.

12. A water craft including and water jet nozzle and a first hull having a stern, together with a second hull coupled to said first hull, said second hull comprising:

a hull body having a stern, having an opening in said stern;

the water jet nozzle of the water craft extending through said opening in said stern;

a sleeve surrounding the water jet nozzle, said sleeve being movable so that it can be adjusted from a position where it does not extend beyond said stern to a position where it extends beyond said stern.

* * * * *